United States Patent [19]

Tantlinger et al.

[11] 3,971,580

[45] July 27, 1976

[54] DUAL RELEASABLE WINDOW LATCH MECHANISM FOR TRANSIT VEHICLE

[75] Inventors: Keith W. Tantlinger, Coronado; Theodor C. Schubach, Bonita, both of Calif.

[73] Assignee: Rohr Industries, Inc., Chula Vista, Calif.

[22] Filed: May 21, 1975

[21] Appl. No.: 579,440

[52] U.S. Cl. ..... 292/201; 292/25

[51] Int. Cl.[2] ..... E05C 15/02

[58] Field of Search ..... 49/94, 141; 292/DIG. 18, 25, 96, 201, 31, 122

[56] References Cited

UNITED STATES PATENTS

| | | | |
|---|---|---|---|
| 3,004,756 | 10/1961 | Williams | 49/94 |
| 3,296,742 | 1/1967 | Mortimer | 292/201 X |
| 3,418,016 | 12/1968 | Levine | 292/96 |
| 3,442,048 | 5/1969 | Elias | 49/141 |
| 3,664,698 | 5/1972 | Stropkay | 292/201 |
| 3,739,527 | 6/1973 | Schubach | 49/141 |

*Primary Examiner*—Richard E. Moore
*Attorney, Agent, or Firm*—Patrick J. Schlesinger

[57] ABSTRACT

In a transit vehicle having a row of hingedly suspended windows along each side thereof, an individually, manually releasable latch is mounted adjacent the lower end of each window. An inflatable latch actuating member is concealed within each latch, and when inflated moves the latch to unlatched condition. Conduit means interconnects a selected plurality of the inflatable latch actuating members and leads to a valve controlled by the vehicle operator, which valve, when actuated, admits pressurized fluid through the conduit means to inflate its selected plurality of inflatable members.

11 Claims, 3 Drawing Figures

DUAL RELEASABLE WINDOW LATCH MECHANISM FOR TRANSIT VEHICLE

BACKGROUND OF THE INVENTION

It is a requirement of the United States Urban Mass Transit Administration of the Department of Transportation that all transit vehicles have windows which can be released by a passenger from within the vehicle. In the past various mechanisms have been designed for releasing the windows of a transit type vehicle, for example, as shown in U.S. Pat. No. 3,004,756. The disclosure of said patent provides for the opening of bottom hinged windows by means of plunger-type mechanisms which are actuated from the driver's compartment, but the structure and inventive concept of this disclosure is in no way suggestive of the present invention. Other mechanisms have been provided for releasably latching the doors of an ordinary passenger automobile, but such prior mechanisms are somewhat complicated and expensive to manufacture and are not readily adapted for use on transit vehicles having windows hingedly suspended from their upper ends as in the present invention.

SUMMARY OF THE INVENTION

In a transit vehicle having a row of hingedly suspended windows along each side thereof, latch means is provided for latching the lower edge of each window. Manual actuating means is provided for the latch means of each individual window, and is operable by a passenger from the interior of the vehicle. Fluid conduit means, with an inflatably expansible element thereof located between relatively movable elements of each latch means, extends lengthwise along each row of windows, and a supply of pressurized fluid is connected, through valve means controlled by the operator of the vehicle, to the conduit means for each row of windows. When the inflatable means is depressurized, each latch means may be moved manually between latched and unlatched position. However, operation of the valve means to admit pressurized fluid to the inflatable elements communicating therewith moves all of the latch means controlled thereby to window-releasing position.

BRIEF DESCRIPTION OF THE DRAWINGS

The objectives and advantages of the invention will be apparent from the following description and the accompanying drawings, wherein.

DETAILED DESCRIPTION OF THE DRAWINGS

Figure 1:
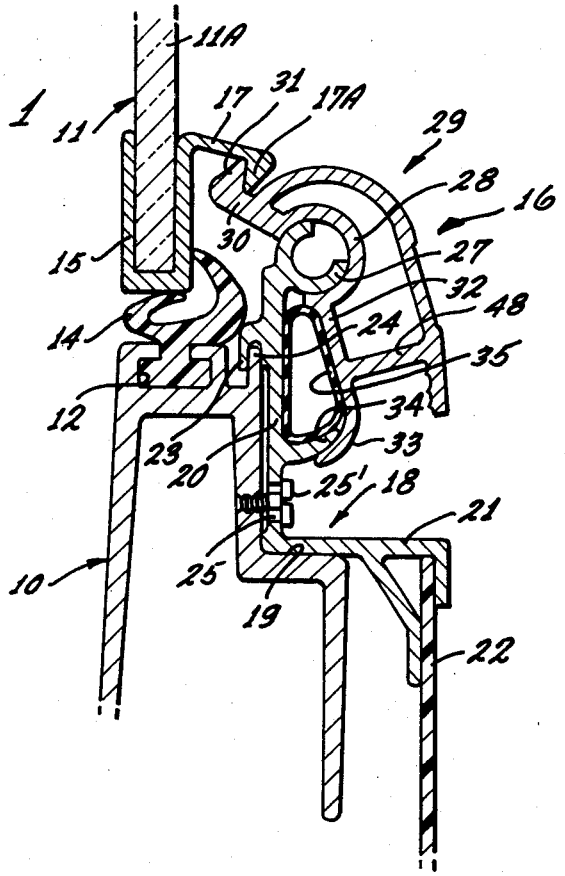
FIG. 1 is a fragmentary, sectional view through the sill portion of a window opening of a transit vehicle in which latch mechanism embodying the present invention is installed, and shows the window in closed, latched condition.

Referring to the drawing in detail, a side wall strake 10 of extruded aluminum, only the upper portion of which is shown, extends along each side of a transit type vehicle below a row of windows 11 therein. The upper edge portion of each strake 10 is formed to define a sill for all of the windows 11, and has a channel 12 formed thereon with undercut sides to receive and retain the T-shape base portion of a window sealing strip 14 of resilient, rubber-like material. The sealing strip 14 has two sealing lips formed integrally therewith for sealing engagement with the bottom and inner side, respectively, of an extruded aluminum channel strip 15 which is fitted onto, and bonded to, the lower edge of each window. An integral latching flange 17 extends inwardly from the upper edge of the inner wall of each window channel 15, and a latch ridge 17A is provided along the under side of the inner edge of each flange 17.

Each window 11 is hingedly suspended from its upper edge by a hinge, now shown, which may be of the type disclosed in U.S. Pat. No. 3,815,284, assigned to the assignee of the present invention. Preferably each window 11 is biased toward slightly open position, either by the shape and structure of its suspension hinge, or by other means which either will be obvious to, or readily designed by one familiar with the art or industry. Such biasing is desired particularly where the vehicle windows are to be washed by the mechanism of the type disclosed in Patent application Ser. No. 509,330, applicant Keith W. Tantlinger, filed Sept. 26, 1974, and assigned to the assignee of the present invention.

A latch 16 is provided for each window 11 and comprises an extruded, aluminum, latch base angle strip 18 seated in an angle seat 19 provided in the upper edge portion of the side wall strake 10. Each latch base angle strip 18 extends substantially the full width of its respective window 11, and comprises an upright flange portion 20 and a laterally inwardly extending flange portion 21, the inner edge portion of the latter being formed as shown in order to support an upright wall liner panel 22.

A hooked mounting flange 23 is formed integrally on the outer side of the upright flange portion 20 for hooked engagement with an upright flange 24 formed on the strake 10 to mount the latch base strip 18 on the strake. A screw 24 is inserted through an upright slotted opening 25 provided in the upright flange portion 20, and is screwed into a threaded hole provided therefor in the strake 10 to permit limited vertical adjustment of the latch base strip 18. Tightening of this screw 24 secures the latch base strip in adjusted position.

A cylindrical segment 27 of over 180° in circumferential extent is formed integrally along the upper edge of each upright flange 20, with its axis parallel to the angle strip 20 of which it is a part.

A latch member 29, having a segmental hub portion 28, is fitted for rocking movement onto the cylindrical segment 27, and is substantially co-extensive therewith. A latching flange 30 extends radially outwardly from the hub portion 28, and is provided along its outward edge with an upwardly extending latch ridge 31, which is shaped and positioned for latching engagement with the latch ridge 17A on the flange 17 when the window 11 is in fully closed position.

A second flange 32 extends angularly downwardly and inwardly from the hub portion 28, and has an outwardly curved lower end portion 33, which cooperates with an inwardly and upwardly curved flange 34 provided on the upright flange portion 20 of the latch base strip 18 to form, with the flanges 20 and 32, an enclosure for receiving and retaining an inflatable latch actuating element 35.

Figure 3:
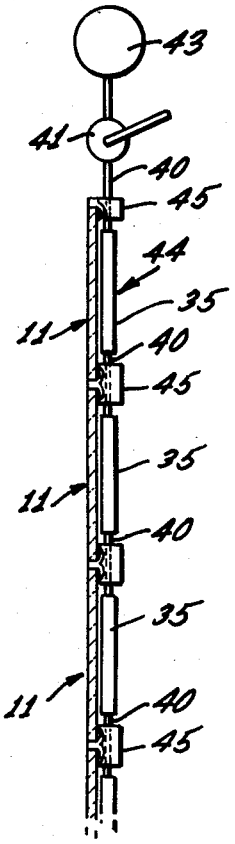
FIG. 3 is a diagrammatic illustration of the duct means extending lengthwise along a row of windows with an inflatable element thereof mounted between relatively movable elements of each of a selected plurality of the latch mechanisms.

Each inflatable element 35 comprises an element of duct means 44 which duct means, as best shown in FIG. 3, comprises a selected plurality of the inflatable elements 35 connected in series, for example, those for an entire row of windows 11 in which the invention is embodied. Each inflatable element 35 may comprise a selected length of thin-wall tubing of rubber or rubber-like material, and either may be a substantially unitary part of the duct means 44, or it may be individual to each window latch and these individual elements interconnected in series by non-inflatable tubing portions 40.

Each entire duct means 44 extends continuously throughout the selected plurality of latches which it controls, and is operably connected, through a suitable valve 41, see FIG. 3, controlled by the driver of the vehicle, to a supply 43 of pressurized fluid, for example, the usual compressed air supply of the vehicle in which the invention is mounted.

Each latch member 29 preferably extends either the entire distance between the sides of its respective window opening, or in end-to end relation with endwise adjacent latch members, so as to provide for minimum exposure of the duct means 44. Preferably mullions 45, see FIG. 3, are provided between adjacent window openings, with openings for the duct means to pass therethrough as shown diagrammatically in FIG. 3. A specific arrangement will, of course, be designed for each type of vehicle in which the invention is to be incorporated, and such designing is well within the capabilities of an ordinarily skilled engineer or designer assigned to the task, and need not, therefore, be described in further detail herein.

A curved flange 34 extends upwardly and inwardly from the upper side of the latching flange 30 over the hub portion 28, and thence angularly downwardly and inwardly substantially parallel to said flange 32. A wall 48 interconnects the flanges 32 and 34, both of which extend beyond the wall 48. The lower edge portion of the flange 34 is thus available for grasping by a passenger within the vehicle for manual operation of the rocking latch member 29, which, like other parts of the illustrated structure, preferably is an aluminum extrusion.

OPERATION OF THE ILLUSTRATED FORM OF THE INVENTION

Assuming that all of the windows 11 of a vehicle in which the invention is incorporated are closed and latched as shown in FIG. 1, any individual latch 16 can be moved between latched and unlatched position by a passenger grasping the lower edge of the flange 34 and rocking the latch member 39 to desired position.

Figure 2:
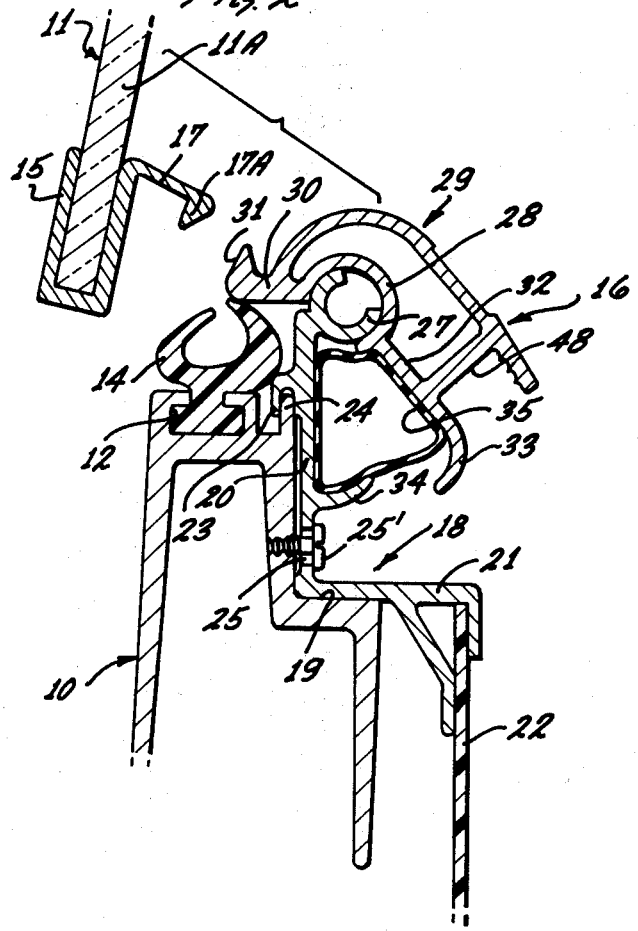
FIG. 2 is a view similar to FIG. 1 with the window unlatched and in slightly open condition.

In the event that it becomes necessary or desirable to unlatch simultaneously all of the windows 11 along one or both sides of the vehicle in which the invention is installed, an operator, not shown, such as the driver of the vehicle in which the invention is embodied, actuates the valve 41, see FIG. 3, controlling such latches to admit compressed air, or other selected, pressurized fluid, from the supply 43 thereof into the duct means 44, thereby inflating the inflatable elements 35 embodied in the latches 16. Inflation of these inflatable elements 35 to their condition shown in FIG. 2, rocks the latch members 29 counterclockwise to their unlatched position of FIG. 2, thereby releasing the windows 11 for outward swinging movement from their hinged upper ends.

The invention provides a single, neat and attractive window latch for transit vehicles, which complies with the requirements of the F.T.A., and at the same time is relatively safe from damage by vandals and pranksters, an important feature in recent times.

Having thus described our invention, what we claim as new and useful and desire to protect by U.S. Letters Patent is:

1. In a transit vehicle having a row of hingedly suspended windows along each side thereof, a dual releasable latch mechanism including a latch for each of said windows, each latch comprising:

a latch base member mounted adjacent the lower edge of each of said windows, a latch member mounted for rocking movement on each latch base member, and manually rockable thereon by a passenger within the vehicle between latching engagement with, and release of, its respective window, an inflatable element concealed in each of said latches between an element of its latch base member and an element of its latch member, each of said inflatable elements being positioned, upon inflation, to rockingly urge its respective latch member toward window releasing condition, duct means interconnecting the inflatable elements of a selected plurality of said latches, and operator controlled valve means for communicating said duct means with a supply of pressurized fluid for simultaneously inflating all of such plurality of inflatable elements and thereby rocking their respective latch members toward unlatched, window releasing condition.

2. A latch mechanism as claimed in claim 1 wherein each of said latch members has a latching flange thereon extending toward its respective window, each of said latching flanges having a latch tooth thereon positioned for latching engagement with an element of its respective window upon rocking its latch member to selected, latching position.

3. A latch mechanism as claimed in claim 2 wherein each window comprises a pane of transparent material, a channel fitted and bonded to the lower edge of each of said window panes, an inwardly extending flange integral with each such channel, and a latch tooth on the inner end of each of said channel flanges shaped and positioned for window latching engagement with the latch tooth on its respective latch member.

4. A latch mechanism as claimed in claim 1 wherein each latch base member is substantially co-extensive with the lower edge of its respective window.

5. A latch mechanism as claimed in claim 4 wherein each latch member is substantially co-extensive with its respective latch base member.

6. A latch mechansim as claimed in claim 1 wherein a first retaining flange extends laterally inwardly from each latch member below its respective inflatable element, and a second retaining flange extends laterally outwardly from each latch base member, also below its respective inflatable element, the two retaining flanges being located to retain their respective inflatable element against displacement during normal operation of the latch.

7. A latch mechanism as claimed in claim 1 wherein each latch base member is in the general form of an angle strip fitted into an angle recess formed in the upper portion of a side wall strake of the vehicle in which the invention is embodied, with one flange of such angle strip upright, the upper portion of such strake being shaped to provide a sill for all of the windows along such strake, means for securing each latch base member in adjusted position in such seat, and a resilient seal strip mounted along the sill of each window outwardly of its respective latch base member, each of said seals being shaped and positioned for sealing engagement with the lower edge of its respective window when such window is in closed, latched position.

8. A window latch mechanism as claimed in claim 7 wherein means mounting each latch member on its latch base member comprises a first hinge element formed integrally along the upper edge of the upright flange of said each latch base member, and a second, cooperating hinge element is provided in said each latch member and is fitted for rocking movement on said each first hinge element.

9. A latch mechanism as claimed in claim 8 wherein a curved flange, integral with an outer portion of each latch member, extends inwardly, in spaced relation, over the hinge element of its latch member, and thence angularly downwardly and inwardly, the lower edge of each of said curved flanges providing an element for grasping by the hand of a passenger within the vehicle for rocking the latch member between latched and window releasing position.

10. A latch mechanism as claimed in claim 1 wherein the inflatable elements of adjacent window latches are interconnected by non-inflatable, tubular duct members.

11. A latch mechanism as claimed in claim 10 wherein the non-inflatable duct members extend through openings provided therefor in vertical mullions mounted between adjacent said windows.

* * * * *